US006181229B1

(12) United States Patent
Anderson

(10) Patent No.: US 6,181,229 B1
(45) Date of Patent: Jan. 30, 2001

(54) TOOL HOLDERS WITH HIGH ENERGY MAGNETIZERS/DEMAGNETIZERS

(76) Inventor: Wayne Anderson, 65 Grove St., Northport, NY (US) 11768

( * ) Notice: Under 35 U.S.C. 154(b), the term of this patent shall be extended for 0 days.

(21) Appl. No.: 09/376,590

(22) Filed: Aug. 18, 1999

Related U.S. Application Data

(63) Continuation-in-part of application No. 09/121,221, filed on Jul. 23, 1998, now Pat. No. 6,026,717, which is a continuation-in-part of application No. 08/710,485, filed on Sep. 18, 1996, now Pat. No. 5,794,497, which is a continuation-in-part of application No. 09/161,855, filed on Sep. 28, 1998, now Pat. No. 6,026,718, which is a continuation-in-part of application No. 08/690,740, filed on Jul. 31, 1996, now Pat. No. 6,105,474, which is a continuation-in-part of application No. 09/161,851, filed on Sep. 28, 1998, now Pat. No. 6,060,801, which is a continuation-in-part of application No. 09/144,813, filed on Sep. 1, 1998, now Pat. No. 6,032,557.

(51) Int. Cl.[7] ..... H01F 7/02

(52) U.S. Cl. ..... 335/306; 81/451; 248/70; 206/350

(58) Field of Search ..... 248/70, 70.6, 70.7, 248/307, 309.1, 309.2, 309.3, 309.4; 206/350; 81/125, 451; 7/125–129; 335/203–207, 285, 302–306

(56) References Cited

U.S. PATENT DOCUMENTS 3,662,303 * 5/1972 Arllof ..... 335/284
5,794,497 * 8/1998 Anderson ..... 81/451
5,861,789 * 1/1999 Bundy et al. ..... 335/285
6,021,891 * 2/2000 Anderson ..... 206/214

* cited by examiner

*Primary Examiner*—Lincoln Donovan
(74) *Attorney, Agent, or Firm*—Lackenbach Siegel Marzullo Aronson & Greenspan

(57) ABSTRACT

A high energy magnetizer/demagnetizer on a non-operative portion of a tool holder includes a magnetizer/demagnetizer body on the non-operative portion of the tool holder and defining a mounting axis. At least one permanent magnet is formed of a magnetized material having North and South poles defining a magnetic axis and arranged on the body of the tool holder to permit selective placement of a magnetizable element at at least one position along the magnetic axis at a predetermined distance from one of the poles to magnetize the element and placement of the magnetizable element at a selected distance from the other of the magnetic poles greater than the predetermined distance to demagnetize the element. In this way, a magnetizable element may be initially magnetized by the magnetizer on the tool holder by positioning same adjacent to one of the poles mounted on the non-operative portion of the tool holder and optionally subsequently demagnetized by positioning the magnetizable element a selected distance from the other of the poles.

46 Claims, 9 Drawing Sheets

TOOL HOLDERS WITH HIGH ENERGY MAGNETIZERS/DEMAGNETIZERS

CROSS REFERENCES TO RELATED APPLICATIONS

This application is a continuation in part of the following applications: Ser. No. 09/121,221 filed Jul. 23, 1998, and issued on Feb. 22, 2000, as U.S. Pat. No. 6,026,717, which is a continuation in part of Ser. No. 08/710,485 filed Sep. 18, 1996, and issued on Aug. 18, 1998 now U.S. Pat. No. 5,794,497; Ser. No. 09/161,855 filed Sep. 28, 1998, and issued as U.S. Pat. No. 6,026,718 on Feb. 22, 2000; Ser. No. 08/690,740 filed Jul. 31, 1996 now U.S. Pat. No. 6,105,474; Ser. No. 08/161,851 filed Sep. 28, 1998, and issued as U.S. Pat. No. 6,060,801 on May 9, 2000; and Ser. No. 09/144,813 filed Sep. 1, 1998, and issued as U.S. Pat. No. 6,032,557 on Mar. 7, 2000.

BACKGROUND OF THE INVENTION

1. Field of the Invention

The present invention generally relates to tools, and more specifically to a high energy permanent magnet magnetizer/demagnetizer for tool holders that can be used for selectively magnetizing and/or demagnetizing a magnetizable element, such as a driver bit, fastener, or the like.

2. Description of the Prior Art

It is frequently desirable to magnetize the tips of screwdriver bits, tweezers and the like to form at a least temporary magnetic pole on the tool which attracts magnetizable elements. Thus, particularly with precision screwdrivers which tend to be relatively small and are used to drive relatively small screws, it is frequently advantageous to at least temporarily magnetize the screwdriver tips of the driver bits to maintain the screwdriver tip blade within the slot of a head of a screw or a Phillips driver within the cross slots formed within the head of the screw adapted to receive the Phillips screwdriver tip. By magnetizing the tip of the driver bit, and mating the tip within the associated opening in the head of the screw, the screw remains attached to the bit tip without the need to physically hold them together. This allows the screw to be guided through a relatively small bore or channel and moved within confined spaces. Sometimes the magnetized tip of the driver bit is used to retrieve a metal item, such as a screw, washer, nail or the like, from an inaccessible place which would otherwise be difficult to reach with anything but a relatively thin shank of a bit driver. Of course, such attachment of a fastener to the driver bit tip also frees one hand for holding or positioning the work into which the fastener is to be driven. In some instances, rather than magnetizing the tip of the driver member bit, the fastener itself is magnetized so that, again, it is attracted to and remains magnetically attached to the driver bit tip in the same way as if the latter had been magnetized.

Conversely, there are instances in which a magnetized driver bit tip is a disadvantage, because it undesirably attracts and attaches to itself various magnetizable elements or components. Under such circumstances, it may be desirable to demagnetize a driver bit tip that had been originally magnetized in order to render same magnetically neutral.

Devices for magnetizing I demagnetizing tools and small parts are well known. These normally incorporate one or more permanent magnets which create a sufficiently high magnetic field to magnetize at least a portion of a magnetizable element brought into its field. The body can be magnetized by bringing it into the magnetic field. While the magnetic properties of all materials make them respondent in some way to magnetic fields, most materials are diamagnetic or paramagnetic and show almost no response to magnetic fields. However, a magnetizable element made of a ferromagnetic material readily responds to a magnetic field and becomes, at least temporarily, magnetized when placed in such a magnetic field.

Magnetic materials are classified as soft or hard according to the ease of magnetization. Soft materials are used as devices in which change in the magnetization during operation is desirable, sometimes rapidly, as in AC generators and transformers. Hard materials are used to supply fixed fields either to act alone, as in a magnetic separator, or interact with others, as in loudspeakers, electronic instruments and test equipment.

Most magnetizers/demagnetizers include commercial magnets which are formed of either Alnico or of ceramic materials. The driver members/fasteners, on the other hand, are normally made of soft materials which are readily magnetized but more easily lose their magnetization, such as by being drawn over an iron or steel surface, subjected to a demagnetizing influence such as strong electromagnetic fields or other permanent magnetic fields, severe mechanical shock or extreme temperature variations.

One example of a stand alone magnetizer/demagnetizer is magnetizer/demagnetizer Model No. 40010, made in Germany by Wiha. This unit consists of a plastic box that has two adjacent openings defined by three spaced transverse portions. Magnets are placed within the transverse portions to provide magnetic fields in each of the two openings which are directed in substantially opposing directions. Therefore, when a magnetizable tool bit or any magnetizable component is placed within one of the openings, it becomes magnetized and when placed in the other of the openings, it becomes demagnetized. The demagnetizing window is provided with progressive steps to stepwise decrease the air gap for the demagnetizing field and, therefore, provides different levels of strengths of the demagnetizing field. However, common magnetic materials that are used with conventional magnetizers/demagnetizers include Alnico and ceramic magnets which typically have energy products equal to approximately $4.5\times10^6$gauss-oersteds and $2.2\times10^6$ gauss-oersteds, respectively.

Since the magnetic field strength "B" at the pole of the magnet is a product of the unit field strength and the area, it follows that the energy content is proportional to the BH product of the magnet. The BH product is a quantity of importance for a permanent magnet and is probably the best single "figure of merif" or criterion for judging the quality of the permanent magnetic material. It is for this reason that conventional magnetizers/demagnetizers have required significant volumes of magnetic material to provide the desired energy content suitable for magnetizing and demagnetizing parts. However, the required volumes have rendered it impossible or impractical to incorporate the magnetizers/demagnetizers on relatively small hand tools. Thus, for example, precision screwdrivers, which are relatively small and have relatively small diameter handles, could not possibly incorporate sufficient magnetic material to provide desired levels of magnetic fields for magnetizing and demagnetizing parts. However, the requirement of using separate magnetizer I demagnetizer units has rendered their use less practical. Thus, unless the user of a precision screwdriver or any driver tool acquired a separate magnetizer/demagnetizer, one would not normally be available for use. Additionally, even if such magnetizer/demagnetizer were available, it would still require a separate component that could be misplaced and not be available when needed. Additionally, there is always the risk that the magnetizer/demagnetizer could become misplaced or lost, rendering the use of the driver tool less useful.

Various magnetizer/demagnetizer applications have been described in my U.S. Pat. No. 5,794,497 issued Aug. 18, 1998, and in my co-pending patent applications Nos. 09/161,851 filed on Sep. 28, 1998; 09/161,855 filed on Sep. 28, 1998; 09/121,221 filed on Jul. 23, 1998; 09/144,813 filed on Sep. 1, 1998; and 08/690,740 filed on Jul. 31, 1996 (CPA application filed Mar. 6, 1998).

In the issued patent and in all of the applications described in the co-pending patent applications, the magnetizer/demagnetizer is mounted on, connected to or connectable to a specific tool, such as a screwdriver or other driving tool, or a drill housing. Therefore, each magnetizer/demagnetizer is "dedicated" to a given hand tool. However, in some instances, it may be desirable to use a magnetizer/demagnetizer in connection with a variety or multiplicity of tools or other magnetizable elements, including fastener drivers, drill bits, etc. Also, it may be desirable to have ready access to such magnetizers/demagnetizers in connection with tools that do not incorporate or embody the same. By incorporating such magnetizers/demagnetizers on the tool holders themselves, these become more universal to a plurality of tools that a user may have.

SUMMARY OF THE INVENTION

It is an object of the present invention to provide a high energy magnetizer/demagnetizer for tool holders.

It is another object of the present invention to provide a magnetizer/demagnetizer on a tool holder as aforementioned which provides sufficiently strong magnetic fields to effectively and adequately magnetize/demagnetize a driver bit and/or a magnetizable component.

It is still another object of the present invention to provide a magnetizer/demagnetizer on a tool holder as in the previous objects in which the magnetizing and demagnetizing fields are created proximate to the surface of a tool holder, such as a tool carrier, tool box or the like.

It is yet another object of the present invention to provide a tool as in the previous objects in which the magnetizer/demagnetizer is provided on a tool holder with one or more openings in which the magnetizing and/or demagnetizing fields are formed for convenient and reliable magnetization and/or demagnetization.

It is a further object of the present invention to provide a magnetizer/demagnetizer on a tool holder as in the previous object that can be incorporated in original equipment (OEM) or can be an add-on to an existing tool holder.

It is still a further object of the present invention to provide a magnetizer/demagnetizer as in the previous object that is simple and convenient to mount or attach to an existing tool holder.

It is yet a further object of the present invention to provide a magnetizer/demagnetizer on a tool holder which uses a permanent magnetic material having an energy product equal to at least $7.0\times10^6$ gauss-oersteds.

In order to achieve the above objects, as well as others which will become apparent hereinafter, a high energy magnetizer/demagnetizer on a nonoperative portion of a tool holder comprises a magnetizer/demagnetizer body on the nonoperative portion of the tool holder and defining a mounting axis. At least one permanent magnet is formed of a magnetized material having North and South poles defining a magnetic axis is arranged on said body of the tool holder to permit selective placement of a magnetizable element at at least one position along said magnetic axis at a predetermined distance from one of said poles to magnetize the element and placement of the magnetizable element at a selected distance from the other of said magnetic poles greater than said predetermined distance to demagnetize the element. In this way, a magnetizable element may be initially magnetized by the magnetizer on the housing of the tool holder by positioning same adjacent to one of said poles mounted on the non-operative portion of the driving tool and optionally subsequently demagnetized by positioning the magnetizable element at a selected distance from the other of said poles.

Said at least one magnet has an energy product equal to $6.0\times10^6$ gauss-oersteds. The high energy magnetizer/demagnetizer body may be at least partially embedded in the nonoperative portion of the housing or may be attached or secured to an exterior surface of such nonoperative portion of the tool holder.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of preferred embodiments in which.

DESCRIPTION OF THE PREFERRED EMBODIMENTS

Figure 1:
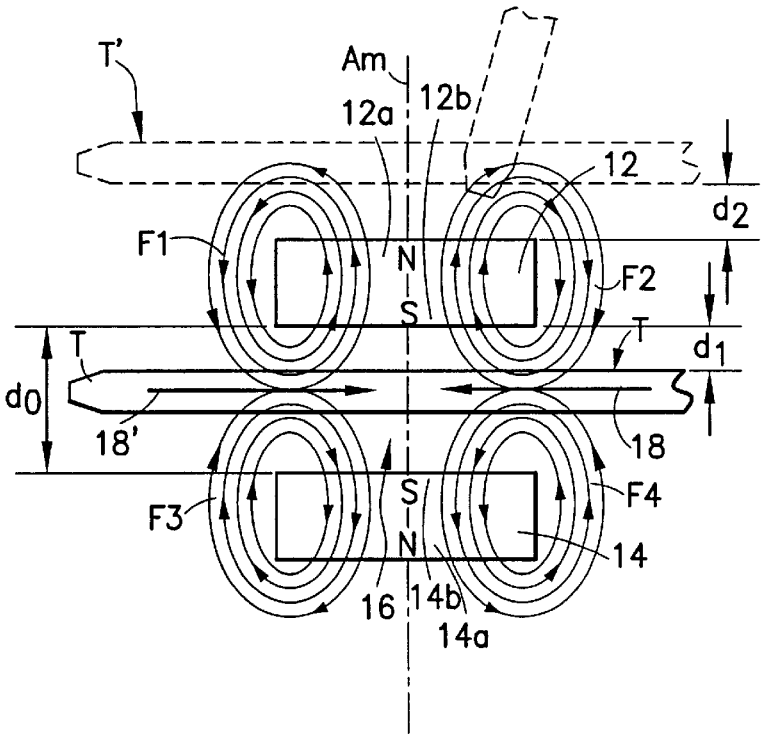
FIG. 1 is a schematic representation of the magnetic fields in the vicinity of two spaced magnets generally aligned along their magnetic axes, and showing a shank of a driver tool, such as a screwdriver shank, passed through the space between the magnets, in solid outline, to magnetize the shank, and also showing, in dashed outline, the same driver shank positioned adjacent to an opposite the pole, to demagnetize the shank.

Referring now specifically to the FIGS., in which identical or similar parts are designated by the same reference numerals throughout, and first referring to FIG. 1, an arrangement of magnets to be used to achieve the objects of the present invention is generally designated by the reference numeral 10. The arrangement includes two spaced magnets 12, 14 spaced from each other a distance $d_0$ such that the magnetic poles of the two magnets are generally aligned with each other along a magnetic axis $A_m$. In FIG. 1, the poles facing each other are the same or similar poles, in the example shown these being south poles "S". Because similar poles of magnets repel each other, it will be evident that the resulting magnetic fields surrounding these magnets will be as depicted in FIG. 1, fields F1 and F2 being diametrically opposing cross sections of a generally continuous field in the shape of a torus surrounding the upper magnet 12 and symmetrically arranged about the magnetic axis $A_m$. Similarly, fields F3 and F4 are cross sectional images of a correspondingly shaped toroidal field symmetrically arranged about the magnetic axis $A_m$ in relation to the lower magnet 14. In the presently preferred embodiments, the magnets 12, 14 are "pill" magnets in the shape of circular cylindrical discs, the axes of symmetry of which coincide along the magnetic axis $A_m$. However, it will be evident to those skilled in the art that the specific shapes of the "cylinders" are not critical and discs having configurations other than circular discs may be used, with different degrees of advantage.

Figure 2:
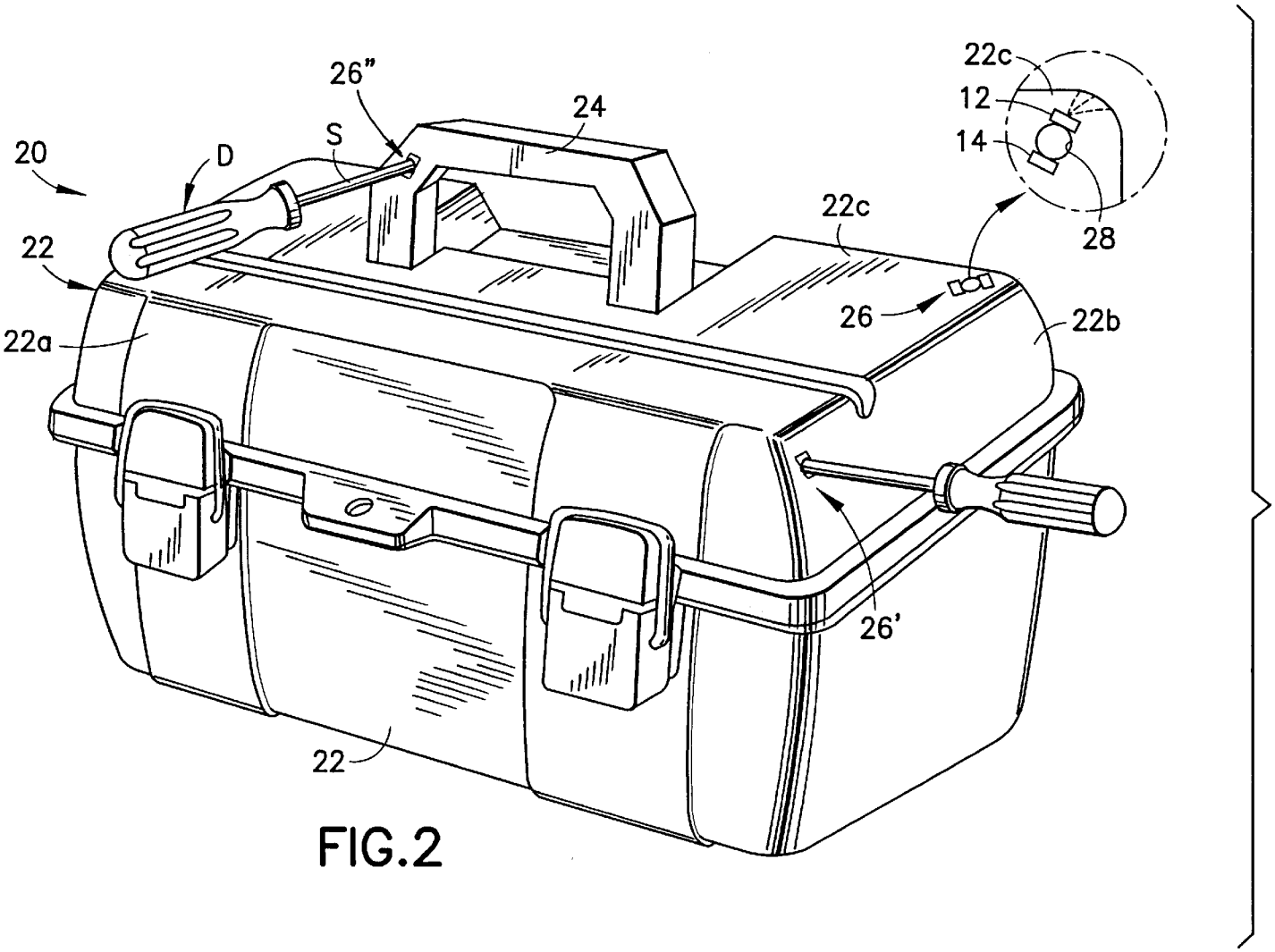
FIG. 2 is a perspective view of a tool box, shown with the cover closed, illustrating three magnetizers/demagnetizers incorporated within the cover of the tool box, one of which is in the handle of the tool box, and further illustrating the details of one of the magnetizers/demagnetizers.

In FIG. 2, a tool holder in the form of a tool box in accordance with the invention is designated by the reference numeral 20. The tool box configuration is not critical and the magnitizer/demagnitizer of the invention may be incorporated into any known or conventional tool box or any tool holder.

The tool box 20 includes a main lower housing or body for receiving tools and a cover 22. The cover 22 has a front wall 22*a*, side walls 22*b*, top wall 22*c* and a rear wall (not shown), and a conventional handle 24. A magnitizer/demagnitizer in accordance with the invention is designated by the reference numeral 26 and, as shown in the inset, consists of a hole 28 in the top wall 22*c* with the magnets 12, 14 being arranged on diametrically opposite sides of the hole, arranged in accordance with the showing in either FIGS. 1–1B. The magnitizer/demagnitizer 26 may also be placed on any of the other walls of the cover, as shown at 26' and 26". In each case the magnitizer/demagnitizer is placed on a portion of the tool holder which is a non-ooperative-operative portion. The term non-ooperative is intended to include any portion of the tool holder which is not actively involved in the functioning/operation of the tool holder. Thus, any such non-ooperative portion of the tool holder may be used for the placement of a magnitizer/demagnitizer that does not interfere with the normal operation of the tool holder. The magnitizer/demagnitizer may also be placed on the main body 22, although the cover is preferred since the main body 22 may be filled with tools and the contents of the tool box may interfere with the insertion of a shank S of a driver D through the wall of the main body 22. Unless the box is totally filled with tools a shank S should be insertable through a hole 28 of a magnitizer/demagnitizer without contacting any tools inside the tool box. Because of the possible interference with tool inside the box a magnitizer/demagnitizer may advantageously be integrated with the handle as shown. If desired, two or more magnitizers/demagnitizers may be mounted on different part of the tool holder, as suggested in FIG. 1.

Figure 3:
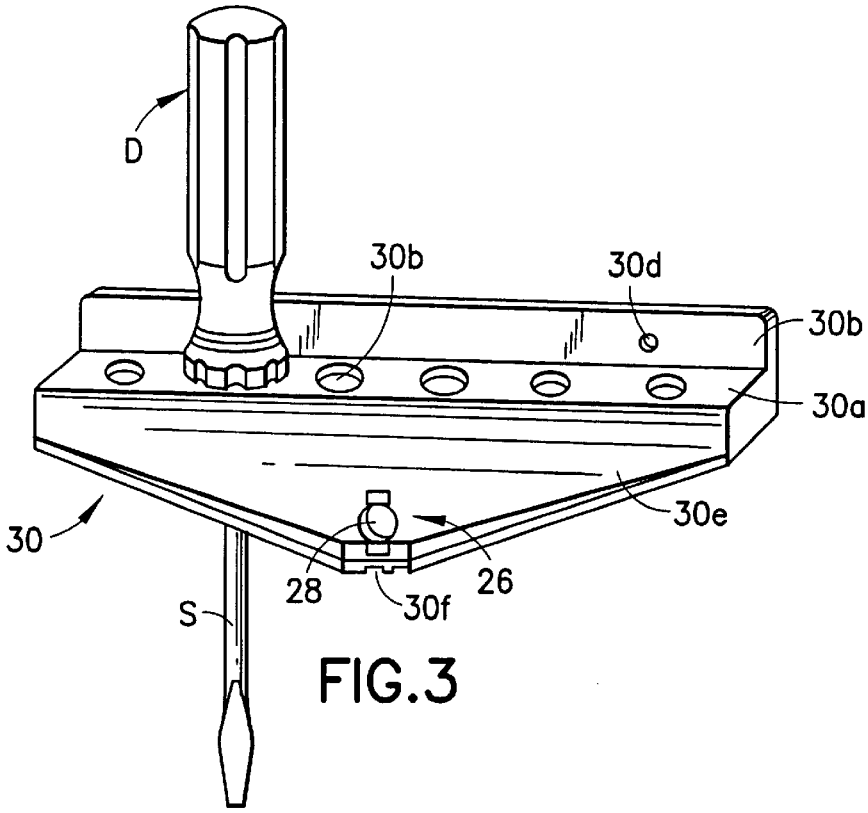
FIG. 3 is a perspective view of a tool holder in the nature of a shelf for mounting on a wall or the like for supporting a plurality of manual drivers, such a screwdrivers.
Figure 4:
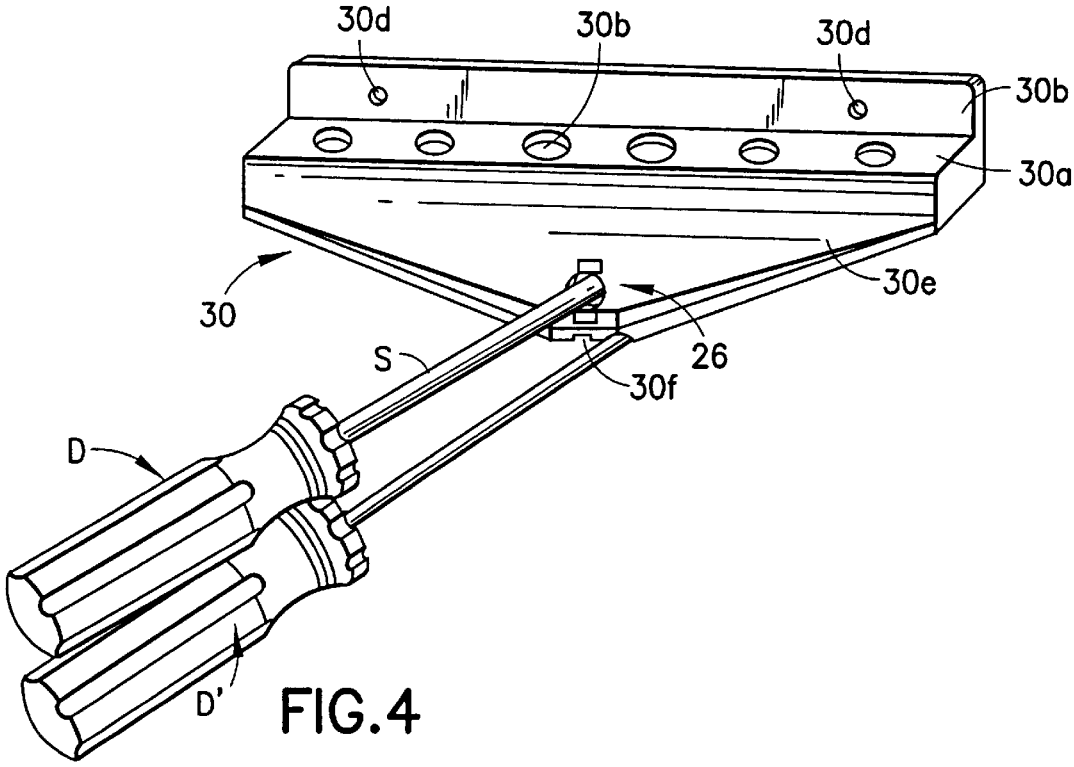
FIG. 4 is similar to FIG. 3, illustrating the two positions of the screwdriver shank and the blade tip during magnetization and demagnetization thereof.

In FIGS. 3 and 4 a tool holder in the form of a shelf 30 is shown which includes an elongate horizontal wall 30*a* provided with a series of holes 30*b* for receiving the shanks S of a series of drivers D as shown. The shanks S hang down vertically and the holes 30*b* are spaced from each other so that the shanks are likewise spaced from each other when drivers are positioned in adjacent holes. A vertical wall 30*c* extends above the wall 30*a* and is provided with mounting holes for mounting of the shelf on a vertical surface, such as a wall. Depending from the front edge of the horizontal wall 30*a* is a front wall or skirt 30*e* provided with a magnitizer/demagnitizer 26 as shown. The magnetizer/demagnetizer 26 is mounted on a portion of the skirt 30*e* which is between adjacent holes 30*b* to clear the shanks of the drivers D when inserted into the shelf to avoid interference therewith. The depth of the horizontal wall 30*a* is selected so that the distance between the walls 30*d* and 30*e* is adequate to extend a shank S through the magnitizer/demagnitizer without making contact with the wall on which the frame is mounted so as not to damage the wall and to ensure that the entire driver tip/blade can be adequately magnetized. In FIG. 4 the upper driver D is shown with its shank S extending through the hole 28 to magnetize the shank while the lower driver D' is shown in abutment against demagnetizing surface 30*f*. In both instances the shank can preferably substantially equally penetrate beyond the skirt 30*e* to insure proper magnetization and demagnetization of the shanks.

Figures 5, 5A, 5B:
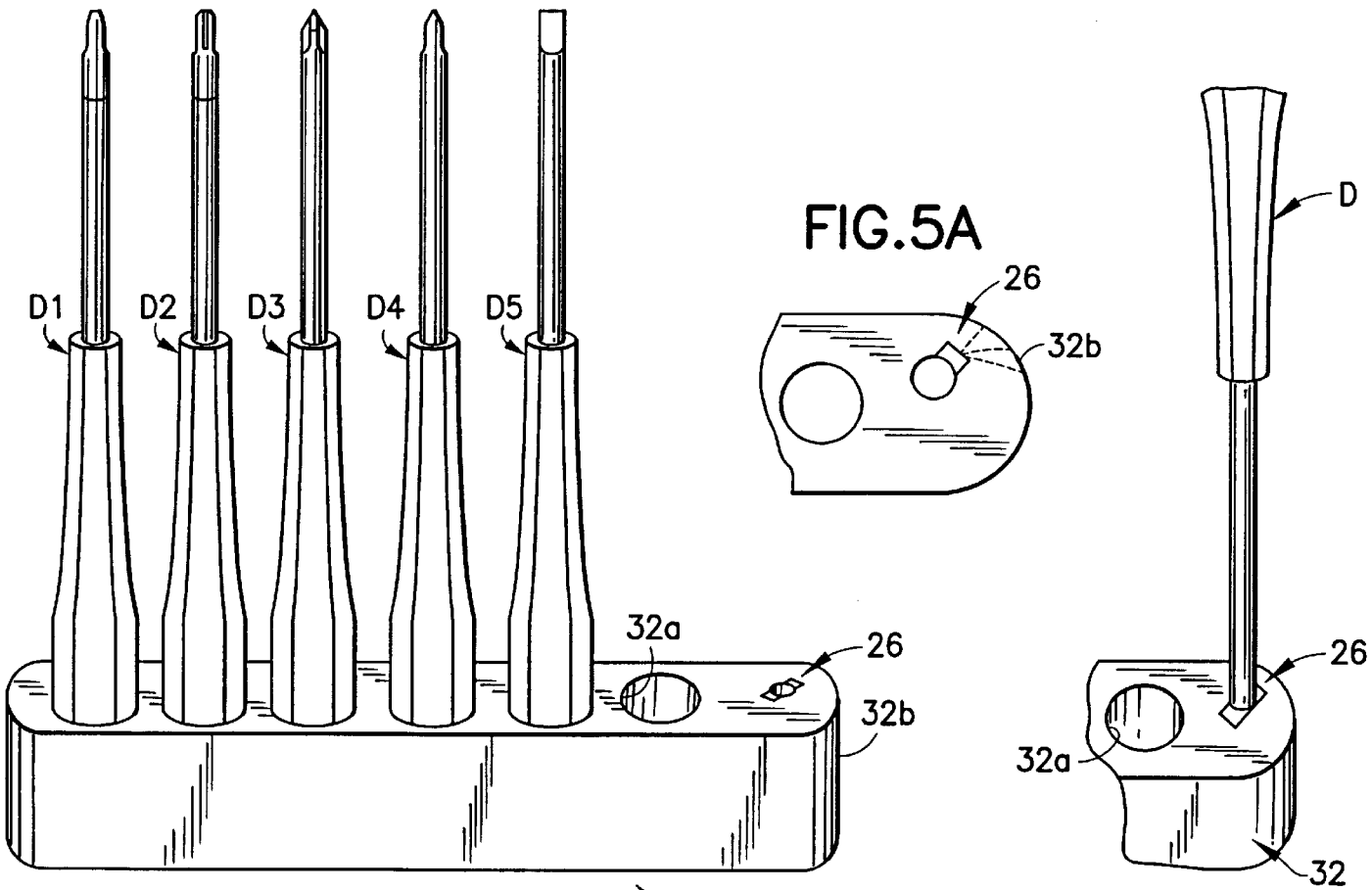
FIG. 5 is a perspective view of a tool holder in the form of a base provided with a plurality of openings for receiving manual drivers, such as screwdrivers, illustrating one magnetizer/demagnetizer in accordance with the invention incorporated therein.
FIG. 5A is a fragmented view of a portion of the base shown in FIG. 5, as viewed from the top, illustrating some details with regard to the magnetizer/demagnetizer.
FIG. 5B is a fragmented view of one end of the base shown in FIG. 5, showing a shank of one of the screwdrivers being magnetized.

In FIGS. 5–5B a tool holder in the form of a base 32 is shown that can be placed on a horizontal surface, such as a table or bench. The base 32 includes a series of spaced holes 32*a* dimensioned to receive the handles of a set of drivers D1–D5 as shown. The non-operative portion of the base is the longitudinal end portion 32*b* that does not interfere with the use of the base. A magnetizer/demagnetizer 26 is incorporated in the portion 32*b* as shown. The curved surface at the end 32*b* allows the positioning of a shank S at different distances from the magnet to thereby allow different levels of demagnetization for different size shanks, bearing in mind that an excessively strong demagnetizing field my undesireably re-magnetize the shank or other magnetizable element with an opposing polarity. Magnetization of a shank in the magnetizer/demagnetizer 26 is shown in FIG. 5B.

Figure 6A:
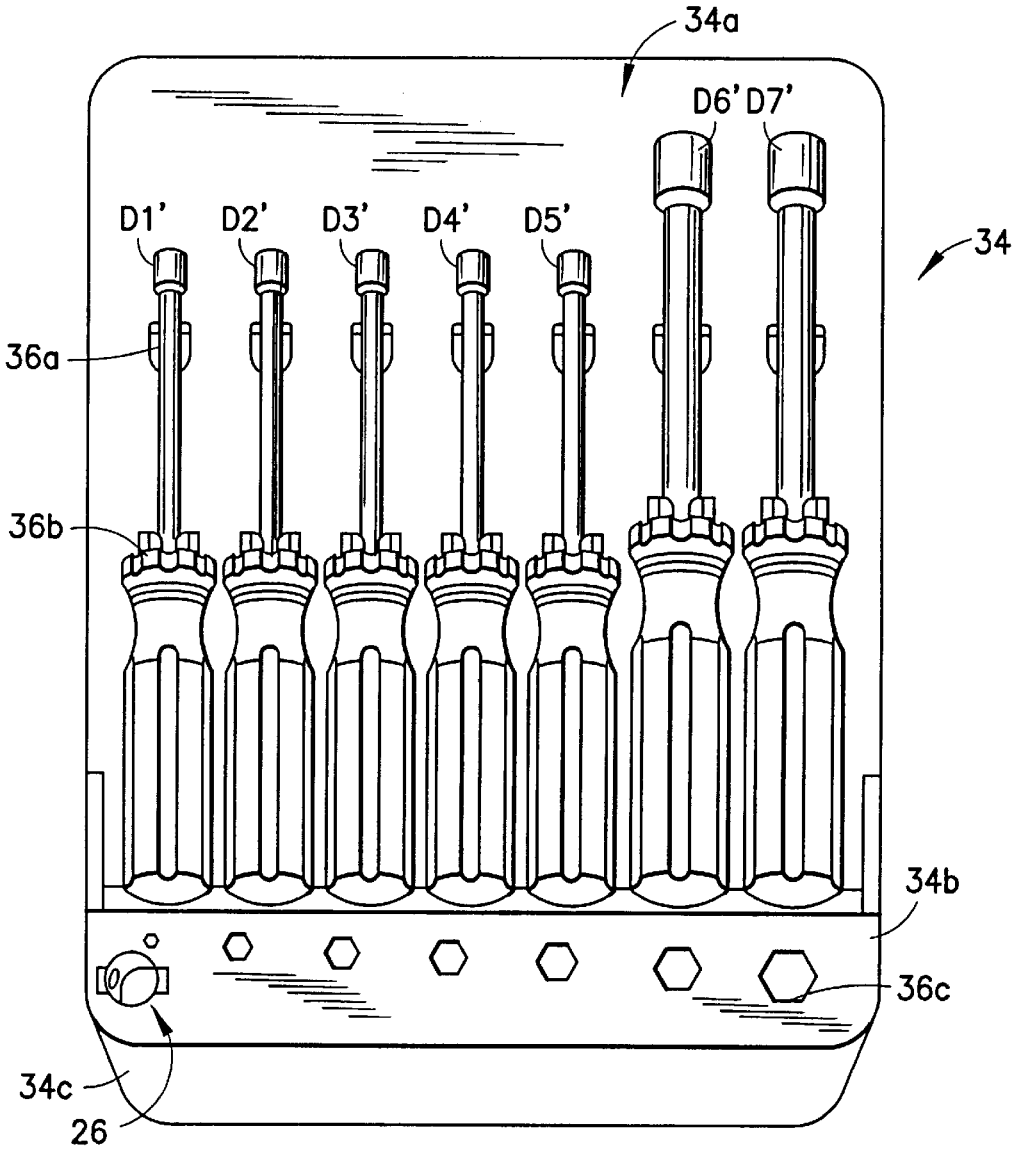
FIG. 6A is a perspective view of a tool holder in the form of a case or tray for receiving a plurality of manual drivers, and illustrating a magnetizer/demagnetizer in accordance with the invention incorporated therein.
Figure 6B:
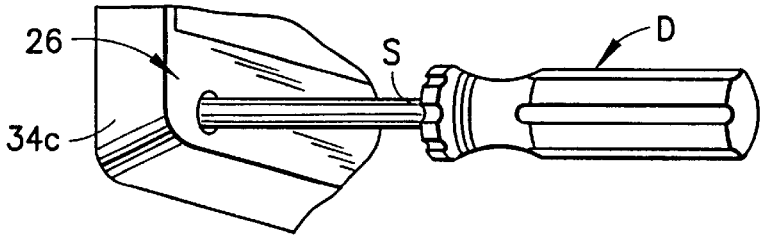
FIG. 6B is a fragmented view of the case or tray shown in FIG. 6A, illustrating the shank of a screwdriver being magnetized.

In FIGS. 6A and 6B a tool holder in the form or a case or tray is designated by the numeral 34. The case or tray 34 includes a driver-receiving compartment 34*a* for receiving a set or series of drivers D1'–D7' in the form of socket drivers. Suitable clips 36*a,* 36*b* maybe used to secure the drivers within the case. A ledge or wall 34*b* may be provided with suitable indicia for identifying the sizes of the sockets of the associated drivers. Here, for example, a non-operative portion of the holder may be a portion 34*c* at one end of the wall 34*b* that does not interfere with the drivers or with the indicia 36*c,* and a magnetizer/demagnetizer 26 is shown on the left side of the wall 34*b,* as viewed in FIG. 6A In FIG. 6B, the shank S of a driver is shown extending through the magnetizer/demagnetizer.

Figures 7A, 7B:
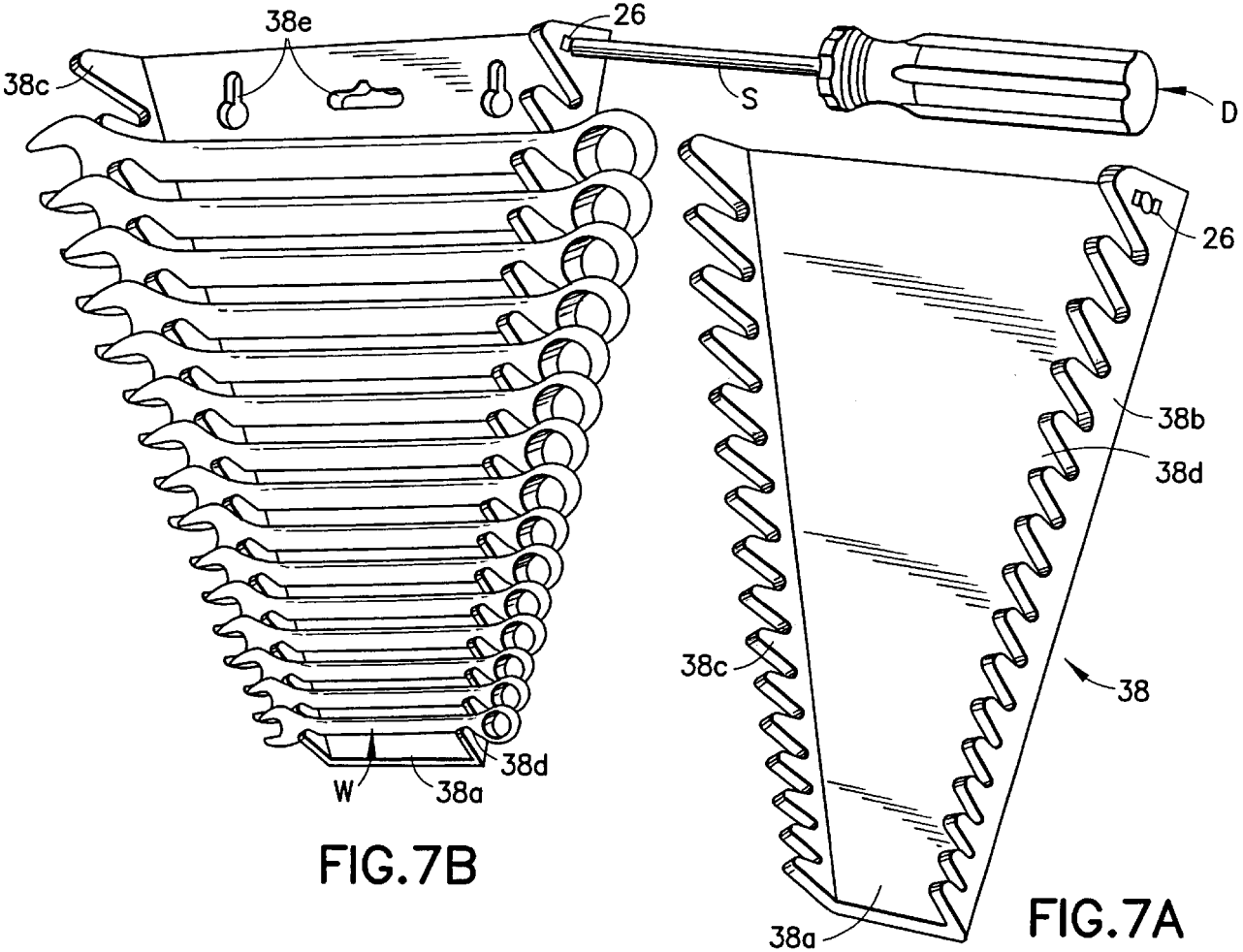
FIG. 7A is a perspective view of a tool holder in the form of a rack for supporting a plurality of drivers, illustrating a magnetizer/demagnetizer in accordance with the invention incorporated therein.
FIG. 7B is similar to FIG. 7A, illustrating a series of wrenches supported on the rack and also illustrating the shank of a driver being magnetized.

In FIGS. 7A and 7B a tool holder in the form of a rack 38 has a generally trapezoidal wall 38*a* with lateral walls 38*c,* 38*d* with recesses or indentations 38*d* as shown. The recesses or indentations are dimensioned to receive the handles or shanks of wrenches W. As with the shelf 30 the wall 38*a* is preferably provided with mounting holes 38*e*. Here, an non-operative portion of the holder may be a portion of the lateral walls that clears the recesses or indentations 38*d* so that the magnetizer/demagnetizer may be used without contacting the wrenchesW when mounted as shown in FIG. 7B, as suggested by the driver D the shank of which is shown extending through the magnetizer/demagnetizer for magnetizing the same.

Figure 8B:
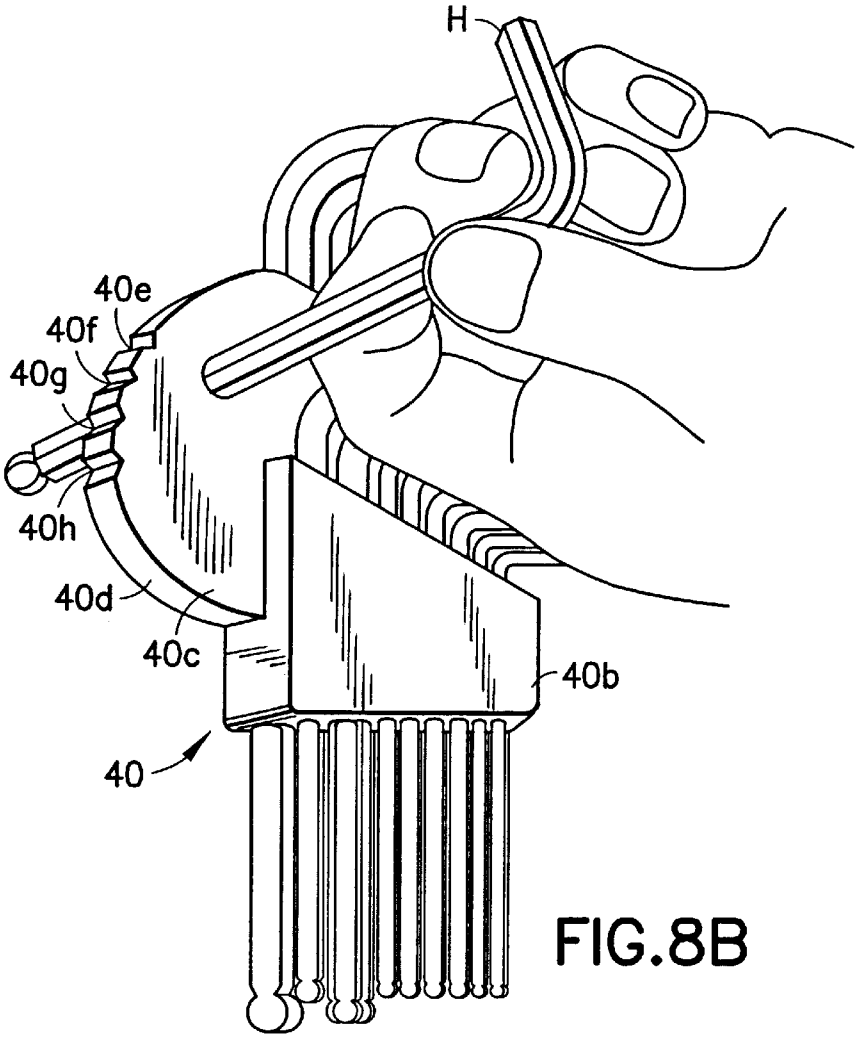
FIG. 8B is a perspective view of the holder shown in FIG. 8A, showing a hex wrench being magnetized.
Figure 8A:
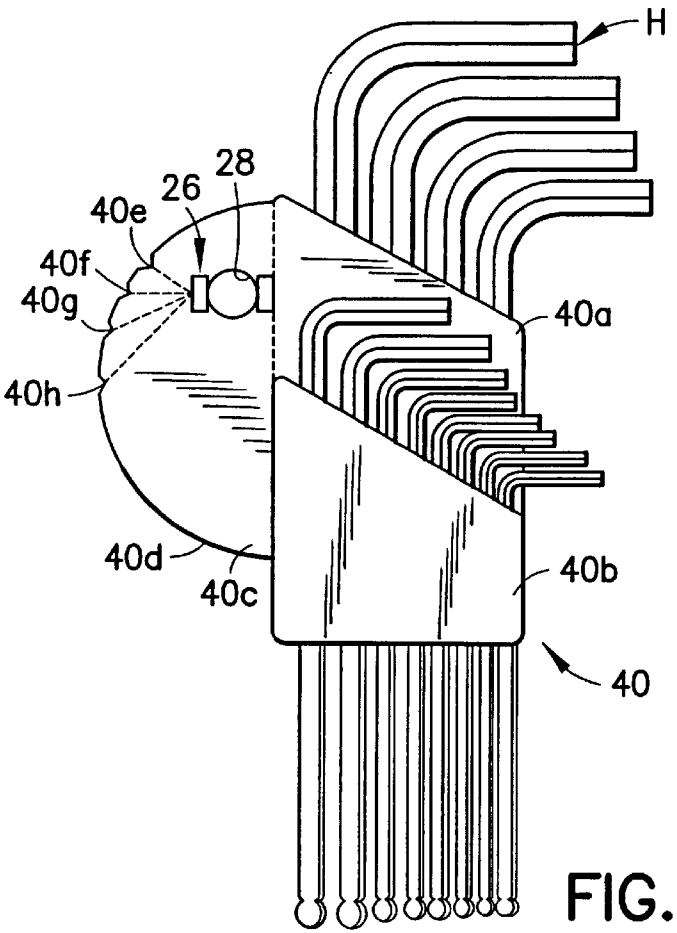
FIG. 8A is a front elevational view of a body for receiving and supporting a set of hex wrenches, incorporating a magnetizer/demagnetizer in accordance with the invention.
Figure 9C:
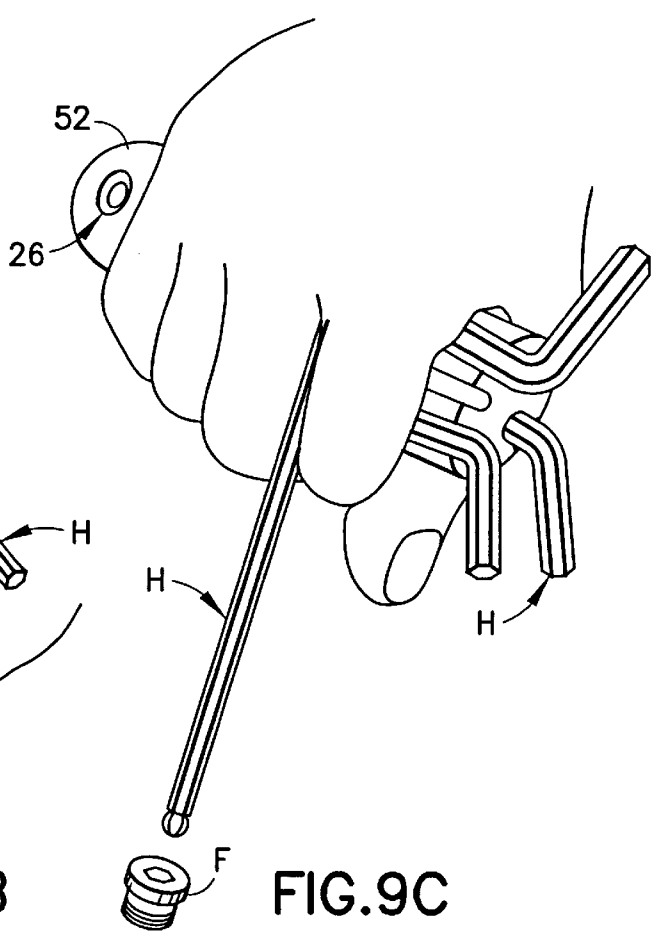
FIG. 9C is a perspective view of the holder shown in FIG. 9A during use with the magnetized hex wrench about to engage a fastener.
Figure 9B:
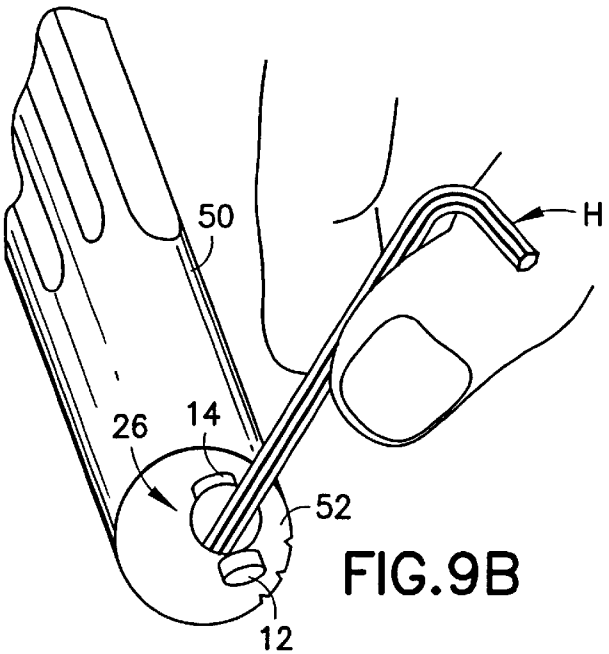
FIG. 9B is a perspective view of the holder shown in FIG. 9A, showing a hex wrench being magnetized.
Figure 9A:
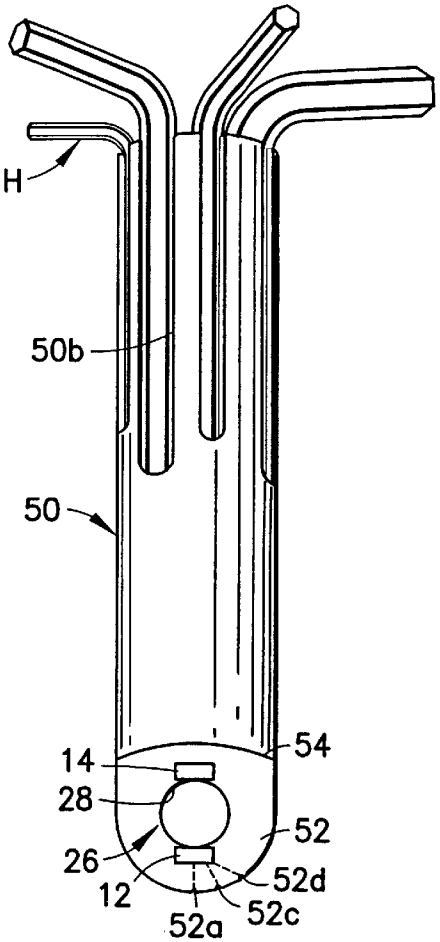
FIG. 9A is a perspective view of an alternative design of a body for receiving or supporting a set of hex wrenches, in which the body supporting the magnetizer/demagnetizer is secured or attached to the supporting body.

A tool holder in the form of a substantially solid body is shown in FIGS. 8A, 8B and designated by the numeral 40. The body 40 may include first and second support portions 40*a,* 40*b* provided with a plurality of openings for receiving correspondingly sized hex-wrenches H as shown, the larger wrenches being received in the portion 40*a* and the smaller wrenches being received in the portion 40*b*. Because of the close proximity of the holes in the portions 40*a,* 40*b* and the closeness of the wrenches there is no convenient non-operative portion on which the magnetizer/demagnetizer 26 may be mounted. Accordingly, a semi-circular extension 40*c* extends from the body which can serve to support the magnetizer/demagnetizer 26, as show. Such extension serves the additional function of providing a suitable arcuate edge 40*c* along which a series of notches 40*e*–40*h* may be provided that can serve as guides for positioning elements to be demagnetized at selected distances from the magnets to thereby control the extent or level of demagnetization for the reasons aforementioned. In FIG. 8B magnetization of a hex wrench H is illustrated. Another embodiment 50 of a hex wrench holder is shown in FIGS. 9A–9C. The holder 50 includes a generally cylindrical body 50*a* provided with elongate recesses 50*b* each dimensioned to receive another hex wrench of a set of such wrenches as shown. By opening the recesses at one axial end of the body 50*a* the wrenches may be secured as shown so that the shorter ends of the wrenches extend radially outwardly in a substantially common plane so that the holder can be placed on a surface with relative stability. At the other axial end of the body 50 a non-operative portion 52 is provided into which a magnetizer/demagnetizer is incorporated as shown. The portion 52 may be integrally formed with the body 50 or may be a separately formed member attached or secured to the body 50 in any known or conventional way such as adhesive, mechanical fasteners, tape, etc. In FIG. 9B a long end of a hex wrench is shown extending through a magnetizer/demagnetizer 26 to magnetize same, while FIG. 9C illustrates the convenient manner in which the holder 50 may be used to engage a fastener F, without interference from the portion 52. As with some of the other embodiments the portion 52 is preferably provided with a curved/spherical surface provided with notches 52*a*–52*c* that can serve as demagnetization guides to control the distances of the magnetizable elements from the magnet(s).

The spaced magnets 12, 14 create a region 16 between these magnets in which the upper and lower fields reinforce each other in the region 16 to produce magnetic components 18, 18' that are radially inwardly directed at diametrically opposite sides of the fields, as shown in FIG. 1. It will be evident, therefore, that a tool T inserted into the space 16 will experience localized fields that are significantly stronger than the fields generated by either one of the magnets and will be roughly twice the strength of the fields generated by either one of the magnets. Additionally, while the idealized representation in FIG. 1 suggests that the magnetic field will be enhanced or magnified only about the peripheries of magnets 12, 14, it will also be evident that an enhanced field will also be generated throughout the space 16.

With a field configuration as depicted in FIG. 1, it will be evident that the insertion of an elongate shank "T" of a driver, such as a screwdriver, drill bit, etc., into the space 16 will experience field reversals as the shank is introduced radially, in relation to the axis $A_m$, from one side of the magnets, through the axis $A_m$ and ultimately out through the diametrically opposite side. In the example illustrated, if a screwdriver is initially inserted from the right-hand side, as viewed in FIG. 1, the tip portion T1 of the driver shank T will initially experience the component 18 which is directed toward the left. As that portion T1 of the shank approaches the magnetic axis $A_m$ (at T2), the magnetic field is relatively neutral, or virtually nonexistent. When the portion T1 of the tool shank passes towards the left through the fields F1 and F3 it will experience a magnetic component 18' and generally directed towards the right. At the same time, an upstream portion T3 of the shank passing through the fields F2, F4 will experience the component 18 toward the left. If the shank T does not proceed further towards the right than illustrated in FIG. 1, there will be upstream portions of the shank, beyond T3, that will not experience the strong magnetic forces created by the magnets 12, 14. As a result of the reversals of the directions of the magnetic fields by the components 18, 18', it will be evident that different portions of the shank T will initially be magnetized in one direction and be subsequently magnetized in an opposing direction. Such reversals in magnetization will continue as the shank T moves through the composite field towards the left when the tool is initially introduced between the magnets, and ultimately moved towards the right when the tool is withdrawn from the space 16. It will also be evident that although the tip T1 of the shank T will initially be magnetized when it is introduced into the space 16 from the right, it will also be the last portion of the shank T to be magnetically altered as it is the last portion to be withdrawn from the space 16 as the tool shank T is moved towards the right.

As will be more fully discussed in connection with FIG. 10, since the magnetic components 18, 18' are extremely strong, the last magnetic component that acts on any portion of the shank will demagnetize any previously magnetized portion and may, depending on the parameters, remagnetize that magnetizable portion consistent with the directions of the magnetic components. In FIG. 1, since the magnetic component 18 is the last component to be experienced by the tip T1 of the driver shank, the removal of that tip portion from the space 16 by movement of the shank towards the right will cause the magnetic component 18 to magnetize the tip T1 with a north pole "N". Therefore, the strong magnetic field within the space 16 will strongly magnetize the tip T1 of the shank T. To demagnetize the tip, when desired or necessary, requires that the tip T1 of the shank be placed within a field in which the field lines are reversed within the tip portion so that the field lines enter instead of leave the tip portion. This can be done by swiping or passing the tip portion T' across an opposite pole, here along the north pole "N" of the upper magnet 12. When the shank T is swiped adjacent the north pole N, as illustrated in dashed outline at T', and the shank is moved from left to right, it will be evident that the upper part of the field F2 will flow in the desired direction within the tip of the driver to effectively demagnetize that tip, in whole or in part, or remagnetize it with an opposing polarity. For reasons which will be more fully discussed in connection with FIG. 10, one feature of the present invention consists of the relative spacings $d_1$, $d_2$ of the driver shank from the initial magnetizing pole "S" and from the demagnetizing pole "N", respectively, such that magnetization of the tool will be assured and efficient, while demagnetization will be substantially complete while avoiding remagnetization with an opposing polarity. As will be evident from the discussion of FIG. 10, the magnetic force required to magnetize a magnetizable material is significantly greater than the magnetic force required to demagnetize that material. A feature of the invention, therefore, is the arrangement of the magnet or magnets in such a way that will position the shank T of the tool to be magnetized closer to the magnetizing pole face than to the demagnetizing pole face. In FIG. 1, this can be established by selecting the distance $d_1$ to be smaller than the distance $d_2$. While the specific distances $d_1$ and $d_2$ are not critical, they should be selected to generally correspond to the magnetizing and demagnetizing forces required to magnetize and demagnetize a specific tool shank T, this being a function both of the size of the shank as well as the specific material from which it is made. The material is important because, as will be evident from FIG. 10, different materials exhibit different magnetic properties, requiring different magnetic intensities or magnetizing forces to produce the same magnitudes of magnetic field or magnetic flux. The dimensions of the material to be magnetized is also important, because the more volume that the tool shank exhibits, the greater the magnetic field that will be required since what is instrumental in magnetizing or demagnetizing the material is not only the absolute intensity of the magnetic field but also the relative density of the field taken across a given cross sectional area of the tool or magnetizable material. In the case of the shank of a screwdriver, for example, the larger the diameter of the shank, the smaller the relative density of the magnetic field for a given amount of available magnetic flux- Therefore, in order to magnetize or demagnetize magnetic materials that are not saturated generally requires magnetic field levels consistent with the geometric dimensions of the shanks.

Figure 1A:
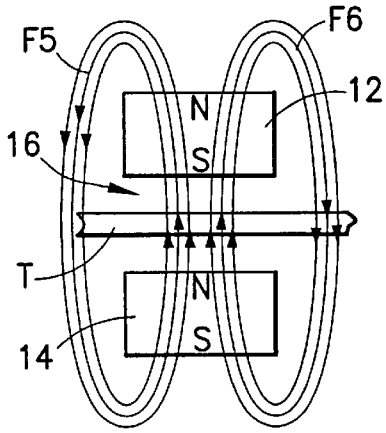
FIG. 1A is generally similar to FIG. 1, but showing a schematic representation of the magnetic fields when the two spaced magnets have their opposing poles facing each other.

In FIG. 1A, a different field configuration is established in the space 16. By flipping the magnet 14 around by 180°, the positions of the poles "N" and "S" are reversed, so that opposite poles now face each other across the gap of the space 16. Since the facing poles now attract, an enlarged field is formed including diametrically opposite sections F5, F6 of a toroidal field symmetrically arranged about the magnetic axis $A_m$. It will be clear that the field components that pass through the tool shank T are essentially perpendicular to the shank instead of being parallel as in FIG. 1. While there will be a number of field reversals as the shank T passes through the space 16, as viewed in FIG. 1A, the magnitude and orientations of the field have less of a magnetizing influence on the tool shank, and the arrangement is less effective than the arrangement shown in FIG. 1.

Figure 1B:
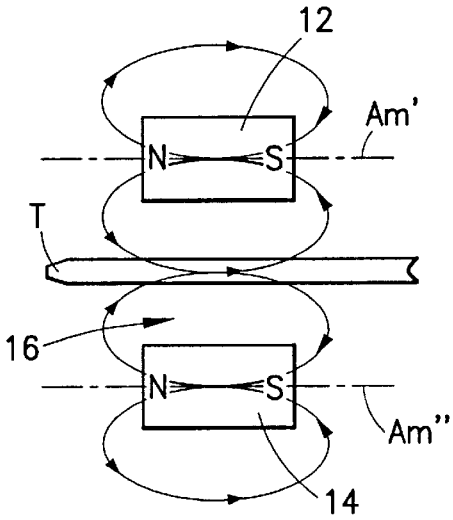
FIG. 1B is an alternative arrangement of the two spaced magnets in which similar poles face the same directions and the two magnetic axes are spaced but substantially parallel to each other.

In FIG. 1B, the two magnets 12, 14 are arranged so that their magnetic axes $A_m'$, $A_m''$ are parallel but offset from each other. The resulting field is similar in some respects to the field shown in FIG. 1, in which each magnet generates its own magnetic field, both fields reinforcing each other in the space 16 through which the tool shank T is passed. However, the field does not reverse as the shank passes through the space and continues to magnetize the shank in the same sense or polarity both when inserted as well as when withdrawn from the space 16. While the embodiment shown in FIG. 1 has been found to be most effective, the embodiments shown in FIGS. 1A and 1B may be used with different degrees of advantage.

It will be evident, therefore, that there are many possible arrangements of magnets in order to practice the present invention. The specific locations of the magnets on the handle are not critical, and one single magnet or two spaced magnets may be used. However, in order to effectively practice the present invention, it is required or highly desirable that the magnetic materials used have a relatively high energy product and that the magnetizable components can at least be positioned at or proximate to the magnetic axes of the magnets.

An important feature of the present invention is the provision of magnetic means on the tool holder for establishing a magnetizing magnetic field accessible for selective placement of a magnetizable element within the field, with the magnetic means being formed by a permanently magnetized material having an energy product sufficiently high so that the size and volume of the permanent magnet can be made sufficiently small so that it can be mounted on or embedded within conventionally sized drill housings. Since the magnetic energy content, or BH product, of a magnetic material is proportional to the volume of the magnet, it has been determined that in order to use permanent magnets with small volumes to be mountable on driver tool handles, the magnetic properties of the permanent magnet materials must be equal to at least $7.0\times10^6$ gauss-oersteds. Magnetic flux lines conventionally leave the North Pole and enter the South Pole, the magnetic flux lines being always closed curves that leave the North Pole and enter the South Pole and always maintain the same direction. Therefore, magnetic flux lines generally exhibit the same directions at both Pole surfaces, with the exception that the flux lines leave from the North Pole and enter into the South Pole. The placement of a soft magnetizable material proximate to either of the polar surfaces, therefore, has the same effect on the magnetic domains of the magnetizable material and would tend to either magnetize or demagnetize the magnetizable material at each of the poles. Since both poles have the same effect on a magnetizable element, it is generally necessary to have at least two permanent magnets which are so arranged so as to provide oppositely directed magnetic fields in order to establish reverse polarizing effects on the magnetizable element. Thus, if one of the magnetic poles of one of the permanent magnets provides a magnetizing effect, the other permanent magnet is preferably so arranged so that the placement of the magnetizable element next to one of its poles will have an opposite or demagnetizing effect.

Because conventional magnetic materials that have been used in the past for magnetizing and demagnetizing have had relatively low energy products BH, they could not be embedded or mounted on conventional driver tool handles. Even when attempts to do so have been made, only single bulky and weak magnets could be provided which would normally serve to magnetize components. However, in accordance with the present invention, two or more magnets can now be easily mounted and/or embedded within conventional portable drill housings to provide strong magnetizing and demagnetizing fields.

Figure 10:
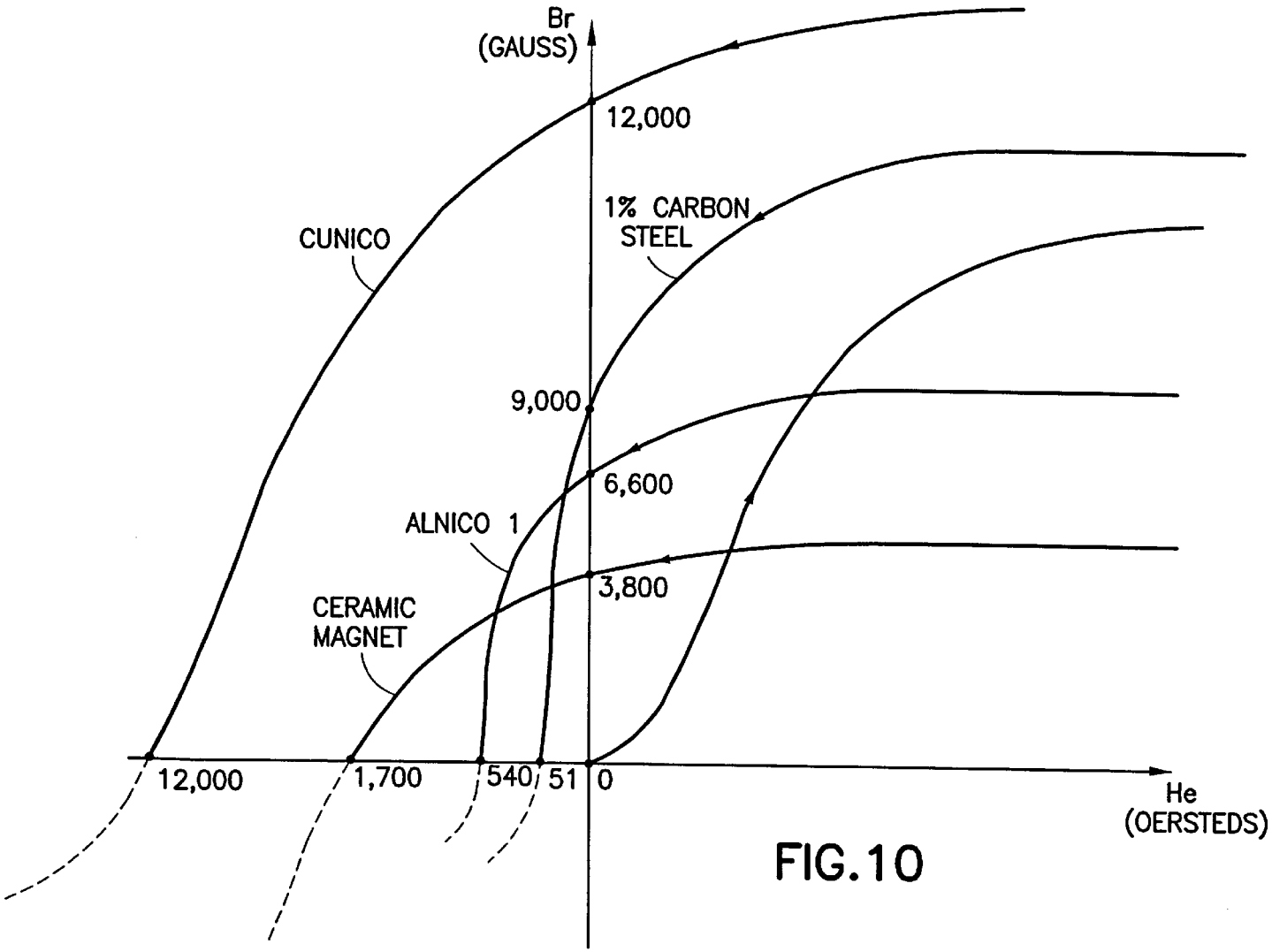
FIG. 10 illustrates partial magnetization curves for some typical representative magnetizable materials, illustrating the magnetizing force required to initially saturate the magnetic materials and, subsequently, to demagnetize such materials.

Referring to FIG. 10, typical BH curves are illustrated for different magnetizable materials. In each case, with the magnetizable material initially totally demagnetized, the curve M illustrates initial magnetization from the origin, such that as the magnetic intensity H is increased, the flux levels within the materials B are correspondingly increased. While initially such relationship may be relatively linear, magnetic materials saturate at a predetermined level such that increases in magnetic intensity H do not result in additional flux being generated. The remaining curves D1, D2, D3 and D4 illustrate the demagnetizing portions of the B–H curves for different magnetizable materials, namely, cunico, 1% carbon steel, alnico and ceramic magnets. It will be evident that these materials not only have different retentive values $B_r$(at H=0) but also require different amounts of reverse magnetization in order to totally demagnetize these materials or revert these to the totally demagnetized states in which B=0. Thus, cunico has a retentive field of 12,000 gauss when demagnetizing force is removed and requires −12,000 oersteds to totally demagnetize the material. One-percent carbon steel has a retentive magnetic field of 9,000 gauss when the magnetic intensity is removed, and requires only −51 oersteds to totally demagnetize such steel. Alnico has a somewhat lower retentive field of 6600 gauss, while requiring −540 oersteds to demagnetize the alnico, while a typical ceramic magnet has the lowest retentive field when magnetic intensity is removed, namely 3800 gauss, while a negative intensity of 1700 oersteds is required to demagnetize this material. Therefore, particularly for 1% carbon steel, alnico and ceramic magnets, it will be evident that the reverse magnetic intensities required to fully demagnetize these materials are relative low and substantially less than the intensities required to saturate and fully magnetize these materials. It is for this reason that the distances $d_1$ in each of the embodiments illustrated was selected to be less than the demagnetizing distances $d_2$.

While this invention has been described in detail with particular reference to preferred embodiments thereof it will be understood that variations and modifications will be effected within the spirit and scope of the invention as described herein and as defined in the appended claims.

What I claim is:

1. A tool holder comprising a first portion for removably holding at least one of a plurality of tools and a second portion; a magnetizer/demagnetizer body on the second portion of the tool holder and defining a mounting axis; and at least one permanent magnet formed of a magnetized material having an energy product of at least about $6\times10^6$ gauss-oersteds and having north and south poles defining a magnetic axis and arranged on said body of the tool holder to permit selective placement of a magnetizable element at at least one position along said magnetic axis at a predetermined distance from one of said poles to magnetize the element and placement of the magnetizable element at a selected distance from the other of said magnetic poles greater than said predetermined distance to demagnetize the element, whereby a magnetizable element may be initially magnetized by the magnetizer on the tool holder by positioning same adjacent to one of said poles mounted on the second portion of the tool holder and optionally subsequently demagnetized by positioning the magnetizable element at a selected distance from the other of said poles.

2. A tool holder as defined in claim 1, wherein said at least one magnet has an energy product equal to at least $7.0\times10^6$ gauss-oersteds.

3. A tool holder as defined in claim 1, wherein one permanent magnet is provided.

4. A tool holder as defined in claim 1, wherein two permanent magnets are provided.

5. A tool holder as defined in claim 1, wherein the second portion comprises a portion of said body provided with a circular hole sufficiently large to receive a magnetizable element to be magnetized, said at least one permanent magnet being arranged adjacent to said hole to position said one of said poles in proximity to the magnetizable element when passed through said hole.

6. A tool holder as defined in claim 5, wherein said hole is substantially aligned with said mounting axis.

7. A tool holder as defined in claim 6, wherein said magnetic axis is offset by 90° from said mounting axis.

8. A tool holder as defined in claim 5, wherein two magnets are arranged on diametrically opposite sides of said hole.

9. A tool holder as defined in claim 6, wherein said magnetic axis is substantially aligned with said mounting axis.

10. A tool holder as defined in claim 9, wherein said body has an external configuration to form a plurality of selectable demagnetizing distances with the demagnetizing pole surface.

11. A tool holder as defined in claim 1, wherein said body is at least partially embedded in said second portion of the tool holder.

12. A tool holder as defined in claim 8 wherein said two spaced permanent magnets have facing pole surfaces of the same polarities.

13. A tool holder as defined in claim 8, wherein said two spaced permanent magnets have aligned magnetic axes and have facing pole surfaces of opposite polarities.

14. A tool holder as defined in claim 1, wherein said body is mounted on an external surface of the second portion of the tool holder.

15. A tool holder as defined in claim 14, wherein said body is attached to said external surface by means of adhesive.

16. A tool holder as defined in claim 14, wherein said body is attached to said external surface by means of adhesive tape.

17. A tool holder as defined in claim 1, wherein said body is made of a nonmagnetic material.

18. A tool holder as defined in claim 17, wherein said nonmagnetic material is plastic.

19. A tool holder as defined in claim 17, wherein said nonmagnetic material is rubber.

20. A tool holder as defined in claim 5, wherein the diameter of said hole is greater than the diameter of said at least one magnet.

21. A tool holder as defined in claim 5, wherein said magnetizer/demagnetizer body is cylindrical in shape with a substantially uniform circular cross section and defining opposing axial ends, the mounting axis being coextensive with the mounting axis of said body.

22. A tool holder as defined in claim 21, wherein said body is provided with a convex surface at one axial end of said body.

23. A tool holder as defined in claim 5, wherein said hole is formed within said body along a direction transverse to said mounting axis.

24. A tool holder as defined in claim 1, wherein said second portion of said housing includes a curved surface and wherein said body has a mounting surface which is curved to enable said body to be mounted on a curved surface of the second portion of the housing.

25. A tool holder as defined in claim 1, wherein said body has a mounting surface which is flat or planar to enable said body to be mounted on a flat surface of the second portion of the housing.

26. A tool holder as defined in claim 1, wherein the tool holder comprises a tool box.

27. A tool holder as defined in claim 26, wherein the tool box has a cover, and said second portion is a portion of said cover.

28. A tool holder as defined in claim 26, wherein the tool box has a handle and said second portion is a portion of the handle.

29. A tool holder as defined in claim 1, wherein the tool holder is a shelf for manual drivers for hanging on a wall, and said second portion comprises a portion of said shelf that clears the drivers when inserted into the shelf.

30. A tool holder as defined in claim 1, wherein the tool holder is a base for placement on a surface and having a plurality of openings for receiving manual drivers, wherein said second portion comprises a portion of a tray that clears the drivers when inserted into said openings.

31. A tool holder as defined in claim 1, wherein the tool holder comprises a case for receiving a plurality of manual drivers, and said second portion comprises a portion of a case that clears the drivers when inserted into said case.

32. A tool holder as defined in claim 1, wherein the tool holder comprises a rack for supporting a plurality of drivers and said second portion comprises a portion of said rack that clears the drivers when supported in said rack.

33. A tool holder as defined in claim 1, wherein said tool holder comprises a body provided with a plurality of openings for receiving a plurality of correspondingly sized hex wrenches, said second portion comprising a portion of said body that avoids contact with the hex wrenches when inserted into said body.

34. A tool holder as defined in claim 1, wherein said tool holder is made of a first material and said second portion is made of a second material different from said first material.

35. A high energy magnetizer/demagnetizer as defined in claim 34, wherein said first material is made of a magnetizable material and said second material is made of a non-magnetizable material.

36. A hand-held driver element holding means comprising a first portion for releasably receiving at least one of a plurality of magnetizable driver elements and a second portion of said holding means; and at least one permanent magnet on said second portion, said at least one magnet being formed of a magnetized material having an energy product of at least about $6\times10^6$ gauss-oersteds and having north and south poles defining a magnetic axis arranged on said second portion to permit selective placement of one of said magnetizable elements at at least one position along said magnetic axis at a predetermined distance from one of said poles to magnetize the magnetizable element and placement of the magnetized element a distance greater than said predetermined distance from the other pole of said magnetic poles to demagnetize the magnetizable element.

37. A hand-held driver element tool holding means comprising a first portion for releasably receiving at least one of a plurality of driver elements and a second portion of said tool holding means; and at least one permanent magnet on said second portion, said at least one magnet being formed of a magnetized material having an energy product of at least about $6\times10^6$ gauss-oersteds and having north and south poles defining a magnetic axis arranged on said second portion to permit selective placement of one of said magnetizable driver elements at at least one position along said magnetic axis at a first distance from one of said poles to magnetize the magnetizable element and placement of the magnetized element at a second position at a second distance from the other one of said poles to demagnetize the magnetizable element.

38. A hand-held driver holding means comprising a first portion for releasably receiving at least one of a plurality of magnetizable drivers, and second portion of said tool holding means, and at least one permanent magnet on said second portion, said at least one magnet being formed of a magnetized material having an energy product of at least about $6\times10^6$ gauss-oersteds and having north and south poles defining a magnetic axis arranged on said second portion to permit selective placement of one of said magnetizable drivers at a predetermined position substantially along said magnetic axis spaced from one of said poles to magnetize the magnetizable driver and placement of the magnetized driver at an axial distance from said other pole less than the axial distance between said other pole and predetermined position to demagnetize the driver.

39. A hand-held driver holding means comprising a first portion for releasably receiving at least one of a plurality of magnetizable drivers, and a second portion of said tool holding means, and a single permanent magnet disposed on said second portion, said magnet being formed of a magnetized material having an energy product of at least about $6\times10^6$ gauss-oersteds and having north and south poles defining a magnetic axis arranged on said second portion to permit selective placement of one of said magnetizable drivers at a predetermined position substantially along said magnetic axis spaced from one of said poles to magnetize the magnetizable driver and placement of the magnetized driver at an axial distance from said other pole less than the axial distance between said other pole and the predetermined position to demagnitize the driver.

40. The hand-held driver holding means of claim 39, said magnet being a rare earth magnet.

41. A hand-held driver element tool holding means comprising a first portion for releasably receiving at least one of a plurality of driver elements and a second portion of said tool holding means; and a single permanent magnet on said second portion, said magnet being formed of a magnetized material having an energy product of at least about $6\times10^6$ gauss-oersteds and having north and south poles defining a magnetic axis arranged on said second portion to permit selective placement of one of said magnetizable driver elements at at least one position along said magnetic axis at a first distance from one of said poles to magnetize the magnetizable element and placement of the magnetized element at a second position at a second distance from the other one of said poles to demagnetize the magnetizable element.

42. The driver element tool holding means of claim 41, said magnet being a rare earth magnet.

43. The tool holder of claim 1, said magnet being a rare earth magnet.

44. The holding means of claim 36, said magnet being a rare earth magnet.

45. The holding means of claim 37, said magnet being a rare earth magnet.

46. The holding means of claim 38, said magnet being a rare earth magnet.

* * * * *